US007153378B2

(12) United States Patent
Sleiman et al.

(10) Patent No.: US 7,153,378 B2
(45) **Date of Patent: *Dec. 26, 2006**

(54) PRODUCT LABELLING

(75) Inventors: Joseph Z. Sleiman, Leamington (CA); Feipeng Zhao, Leamington (CA); Peter C. Nielsen, Leamington (CA)

(73) Assignee: Joe & Samia Management Inc. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/719,636

(22) Filed: Nov. 21, 2003

(65) Prior Publication Data

US 2005/0109443 A1 May 26, 2005

(51) Int. Cl.

| | |
|---|---|
| ***B65C 3/00*** | (2006.01) |
| ***B65C 9/06*** | (2006.01) |
| ***B65C 9/40*** | (2006.01) |
| ***B65C 9/42*** | (2006.01) |

(52) U.S. Cl. ..... 156/64; 156/350; 156/361; 156/362; 156/363; 156/538; 156/539; 156/542; 271/91; 271/98; 271/211

(58) Field of Classification Search ..... 156/64, 156/350, 351, 356, 357, 360–363, 541, 542, 156/556, 566, 567, DIG. 24, 28, DIG. 31, 156/37, DIG. 38, 44; 414/793, 737, 752.1, 414/797; 294/64.1, 64.2; 222/335; 221/211; 271/91, 94, 96, 98, 102, 103, 106, 107, 112, 271/132, 196

See application file for complete search history.

(56) References Cited

U.S. PATENT DOCUMENTS

| | | | | |
|---|---|---|---|---|
| 4,574,393 | A | 3/1986 | Blackwell et al. | |
| 5,155,683 | A * | 10/1992 | Rahim | 701/25 |
| 5,448,652 | A | 9/1995 | Vaidyanathan et al. | |
| 5,645,680 | A | 7/1997 | Rietheimer | |
| 5,848,189 | A | 12/1998 | Pearson et al. | |
| 6,257,294 | B1 | 7/2001 | Weisbeck | |
| 6,349,755 | B1 | 2/2002 | Sardo | |
| 6,493,079 | B1 | 12/2002 | Piacentini | |
| RE38,275 | E | 10/2003 | Ruppert | |
| 2002/0189741 | A1 * | 12/2002 | Nielsen et al. | 156/64 |

FOREIGN PATENT DOCUMENTS

| | | |
|---|---|---|
| DE | 197 50 204 A1 | 5/1999 |
| WO | WO 97/02951 | 1/1997 |
| WO | WO 02/102669 A2 | 12/2002 |

OTHER PUBLICATIONS

A brochure "TL-4 High Speed Tray Labeling System" by Sinclair Systems International, LLC of California, U.S.A., published Apr. 29, 1999.

"Labeling plant for objects of different sizes", DE 19750204, May 27, 1999, Etifix Etikettiersysteme GMBH, esp@cenet—Document Bibliography and Abstract.

* cited by examiner

*Primary Examiner*—Melvin Mayes
(74) *Attorney, Agent, or Firm*—Warner Norcross & Judd LLP

(57) ABSTRACT

A product labeling apparatus has a plurality of labelers, an imager for imaging products; and a processor responsive to an output of the imager and operatively connected to a control input of each of the labelers. The processor processes an image received from the imager to identify a portion of a product which portion will pass a target area of a given labeller. The processor then tracks progress of that portion of the product and controls an appropriate one of the labelers to label the portion of the product when that portion of the product is at the target area of the given labeler.

24 Claims, 4 Drawing Sheets

PRODUCT LABELLING

BACKGROUND OF INVENTION

This invention relates to product labelling.

Products to be sold are commonly labelled. In this regard, automatic labelling apparatus may be employed where the products are smaller and processed in large volumes. One approach in this regard is to wipe a label onto each product as its passes a labelling head. This approach, however, is only well suited for labelling products of uniform dimensions. Where products have irregular dimensions, such as agricultural produce, the distance between a given product and the labelling head will vary. To label such products, tamping labellers are typically used. U.S. Pat. No. 6,257,294 to Weisbeck discloses a tamping labeller. In Weisbeck, a turret carries a number of reciprocating pick up heads about its periphery. The turret has a vacuum plenum and a positive pressure plenum. The turret rotates each head, consecutively, to a labelling station. A head normally communicates with the vacuum plenum which keeps it in a retracted position; also, due to end perforations in the head, the negative pressure holds a label at the end of the head. However, when the head reaches the labelling station, it is coupled to the positive pressure plenum which causes the head to rapidly extend until it tamps a product below. The force of the tamping forms an adhesive bond between the pressure sensitive adhesive of the label and the product. Labels are fed to each pick-up head from a label cassette with a label web comprising serially arranged labels on a release tape.

The labelling apparatus of Weisbeck is suited to label a continuous line of products passing under the labeller. However, more typically, agricultural produce which is to be labelled arrives in trays, each tray having an arrangement of cup-like depressions which hold the products. In order to label products in a tray, a bank of tamping labellers may be used and the trays conveyed underneath this bank of labellers. However, with this set-up, some mechanism is required to ensure that the labellers, when tamping, do not miss the products. One approach in this regard is to use a limited number of types of trays to hold the products, where each type of tray has a pre-defined pattern of cup-like depressions. The labelling apparatus may then be configured to expect products to be arranged in a certain pattern, with the expected pattern being based on the type of tray that will next pass under the labellers. With such a system, a vision system may be used to detect the type of tray.

A drawback with this approach is that products may not be present in each of the tray cups. A further drawback is that some types of products, such as vine ripened tomatoes, may have obstructions (the vines) which may end up being labelled rather than the product itself.

Therefore, there remains a need for more accurate product labelling apparatus.

SUMMARY OF INVENTION

A product labelling apparatus has a plurality of labellers, an imager for imaging products, and a processor responsive to an output of the imager and operatively connected to a control input of each of the labellers. The processor processes an image received from the imager to identify a portion of a product which portion will pass a target area of a given labeller. The processor then tracks progress of that portion of the product and controls an appropriate one of the labellers to label the portion of the product when that portion of the product is at the target area of the given labeller.

In one aspect, the imager may be a colour camera. In such instance, the image may be filtered to leave a first range of colours which may represent the colours of the products. The filtered image may be processed to obtain a plurality of groups of blobs, each blob comprising an area of the first range of colours and each group of blobs representing a product. A blob may then be selected from a given group of blobs which blob represents a portion of a product which will pass a target area of a given labeller. The progress of the product represented by the given group of blobs is tracked and the given labeller is controlled to label the noted portion of the product.

In accordance with the present invention, there is provided product labelling apparatus, comprising: a plurality of labellers, each for labelling a product which is within a target area; an imager for imaging products; a processor responsive to an output of said imager and operatively connected to a control input of each of said plurality of labellers for: processing an image received from said imager to identify a portion of a product which portion will pass a target area of a given labeller; and tracking progress of said portion of said product and controlling an appropriate one of said plurality of labellers to label said portion of said product when said portion of said product is at said target area of said given one of said plurality of labellers.

In accordance with another aspect of the present invention, there is provided product labelling apparatus, comprising: a labeller for labelling products; a camera for capturing an image of a product; a processor responsive to receiving said image from said camera and operatively connected to a control input of said labeller for: processing said image to reduce said image to a representation of a plurality of blobs; analysing said representation to select a one of said plurality of blobs within a labelling area of said labeller; and controlling said labeller such that said labeller applies a label to a target area of said product, where said target area of said product corresponds to said one of said plurality of blobs within said labelling area of said labeller.

In a further aspect of the present invention, there is provided a method for labelling agricultural produce, comprising: imaging products; from said imaging, identifying a portion of a product which portion will pass a target area of a given labeller; and tracking progress of said portion of said product and controlling an appropriate one of said plurality of labellers to label said portion of said product when said portion of said product is at said target area of said given one of said plurality of labellers.

In another aspect of the present invention, there is provided a method for labelling agricultural produce, comprising: imaging products; filtering said image to leave a first range of colours representative of colours of said products; obtaining a plurality of groups of blobs, each blob comprising an area of the first range of colours and each group of blobs representing one of said products; selecting a blob from a given group of blobs, which blob represents a portion of a given product which will pass a target area of a given labeller; tracking said given product represented by said given group of blobs and controlling said given labeller to label said portion of said given product.

Other features and advantages of the invention will become apparent from a review of the following description in conjunction with the drawings.

BRIEF DESCRIPTION OF THE DRAWINGS

In the figures which illustrate example embodiments of the invention.

DETAILED DESCRIPTION

Figure 1:
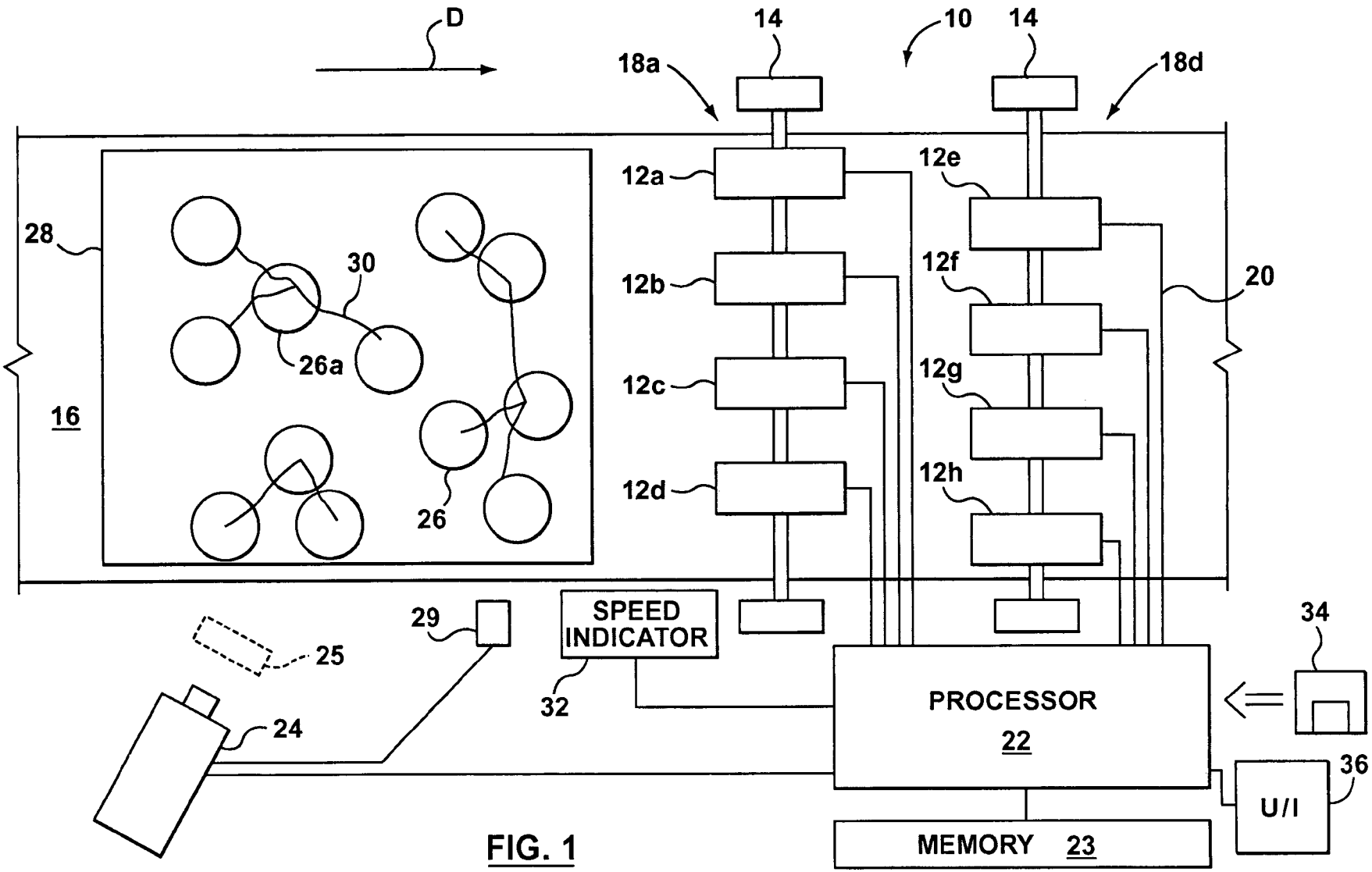
FIG. 1 is a plan schematic view of a labelling apparatus made in accordance with this invention.

Turning to FIG. 1, a labelling apparatus 10 comprises labellers 12*a* to 12*h* (referred to individually as labellers 12) mounted by mounts 14 at a fixed position above a conveyor 16, which moves in a downstream direction D. The labellers 12 are arranged as an upstream bank 18*u* of labellers (12*a* to 12*d*) and a downstream bank 18*d* of labellers (12*e* to 12*h*). Each bank 18*u*, 18*d* of labellers extends transversely of the conveyor 16. The labellers in a bank are equally spaced and the labellers of the downstream bank 18*d* are offset from those of the upstream bank 18*u* so that each labeller has a different transverse position over the conveyor. Further, the labellers 12 extend substantially across the width of the conveyor so as to provide eight distinct transverse positions across the conveyor. The labellers 12 are operatively connected to a processor 22 on paths 20. The processor has an associated memory 23 and user interface 36. Memory 23 is loaded with software so that the processor may operate as hereafter described from a computer readable medium which may be, for example, a disk 34, a CD-ROM, a solid state memory chip, or a file downloaded from a remote source.

The labellers 12 are downstream of an imager 24, which in this embodiment is a colour camera; a filter 25 may be positioned in front of the camera. The camera is arranged to image an area of the conveyor and output this image to the processor 22. In this regard, products 26 may be carried in trays 28 and the camera may image an area which captures one such tray. A photocell 29 may detect the leading edge of a tray when the tray is within the field of view of the camera and output a detect signal to the camera 24 which prompts the camera to capture an image of the tray. The photocell may also output directly to processor 22. A conveyor speed indicator 32 (which, for example, may be a rotary encoder, a sensor which senses marks on the conveyor, or, where the conveyor moves at a known constant speed, simply a timer) also outputs to the processor.

Figure 2:
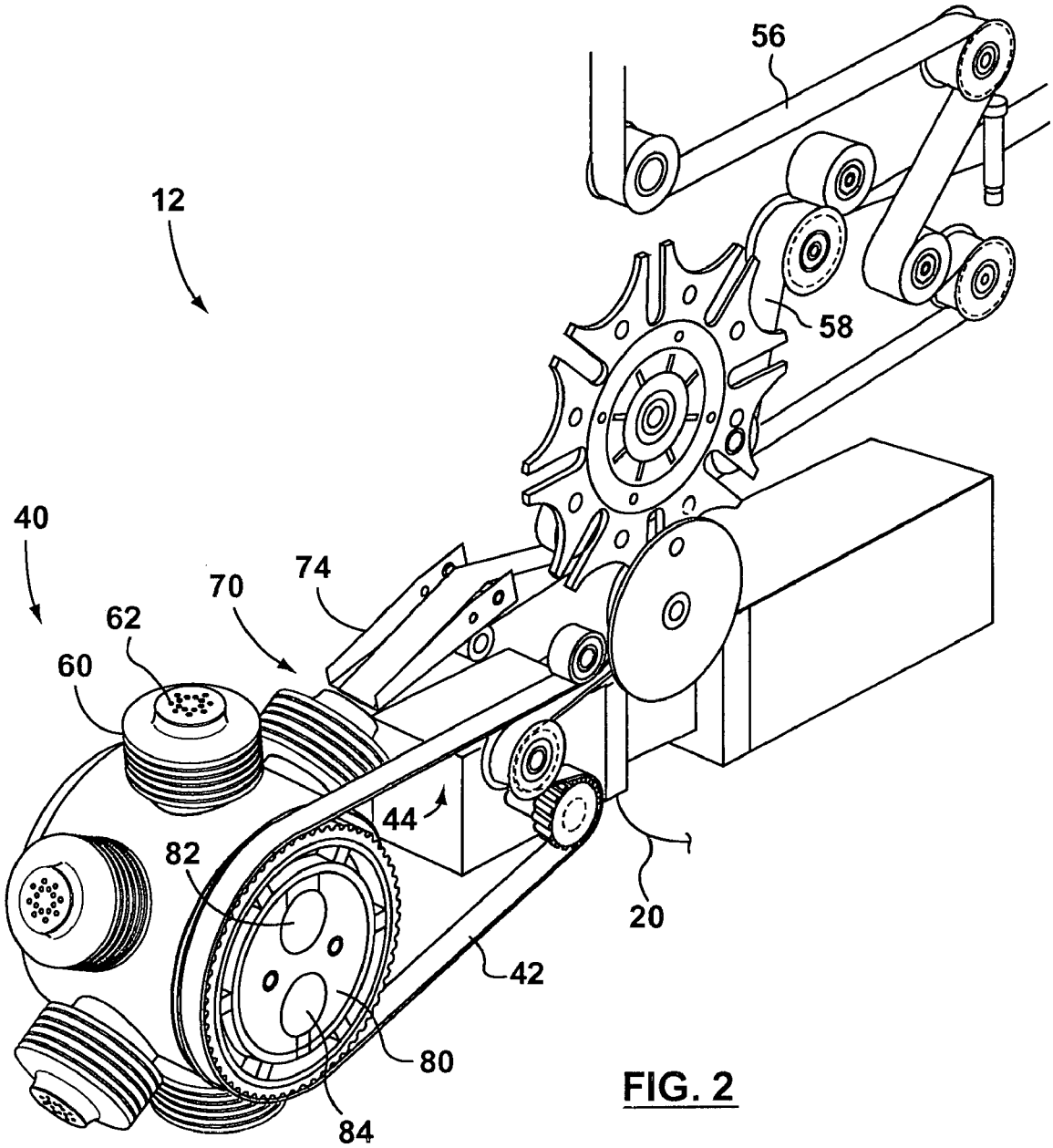
FIG. 2 is a perspective view of a possible configuration for each labeller in the apparatus of claim 1.

Referencing FIG. 2, an example labeller 12 has a rotatably mounted turret 40. A timing belt 42 connects the turret 40 to a stepper motor 44. A label cassette (not shown) has a cassette magazine (not shown) to which is wound a label web 56. The web comprises a release tape 58 carrying a plurality of labels backed with a pressure sensitive adhesive. The label web extends from the cassette magazine along a tongue 74 to a label pick-up station 70, with the release tape 58 returning. A communication path 20 from the processor 22 (FIG. 1) terminates at stepper motor 44.

The turret 40 has a stationary core 80 with a port 82 for connection to a vacuum source (not shown) and a port 84 for connection to a source of positive pressure (not shown). A bellows 60 fabricated of flexible material, such as rubber or silicone, is stretched over a lip of each air diffuser (not shown) extending from the turret 40. The tamping end 62 of each bellows is perforated with pin holes. Further details of example labeller 12 may be had from WO 02/102669 published Dec. 27, 2002, the contents of which are incorporated by reference herein.

Another exemplary tamping labeller is a piston-type tamping labeller, such as the afore-referenced labeller of U.S. Pat. No. 6,257,294 to Weisbeck, the contents of which are incorporated by reference herein. Also, it will be appreciated that if the products are of a reasonably uniform nature, other types of labellers may be suitable, such as a labeller which wipes labels onto the products.

Tray 28 may have a pattern of cup-like depressions, however, as illustrated in FIG. 1, not all of the depressions may hold a product. Thus, the products are unpredictably positioned in the tray. For example, as illustrated, the products may be vine ripened tomatoes which remain attached to vines 30 such that the products are irregularly spaced.

Figure 3:
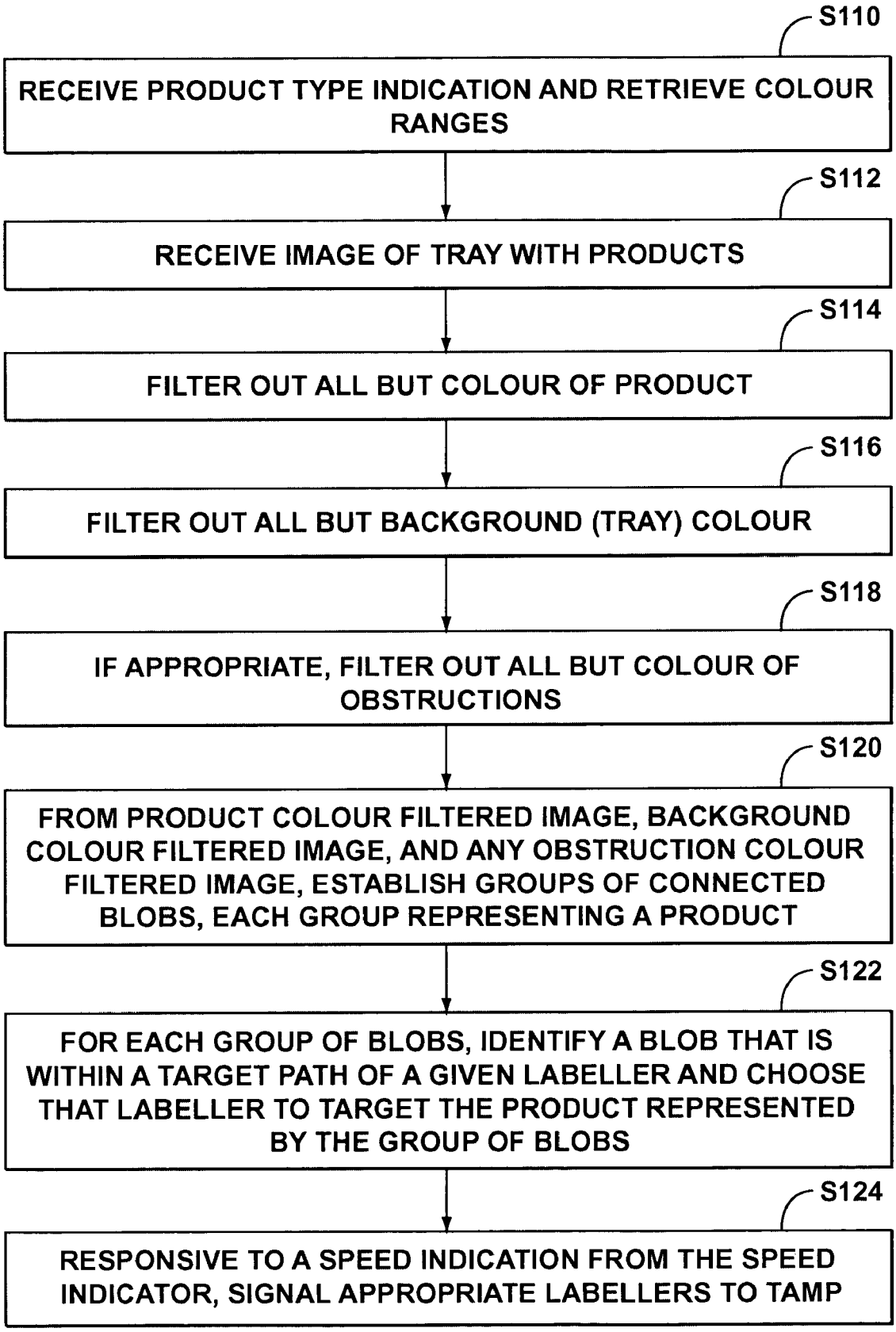
FIG. 3 is a flow diagram illustrating the operation of a processor of the apparatus of FIG. 1.

With reference to FIG. 3 along with FIG. 1, in operation, a user, through interface 36, may input the type of products that will be held by trays 28 placed on conveyor 16. With this information, the processor may retrieve from memory 23 a range of foreground colours indicative of the predominant colour of the products, a range of colours of any obstructions, and a range of background colours indicative of the colour of the trays (S110). In this regard, the trays may be manufactured so as to uniformly have a colour which is distinct from the colour of any product that will be labelled by labelling apparatus 10. For example, the trays may be blue in colour and, if so, memory 23 stores a range of blue colours as the background colour.

If, for example, the user indicates that the products to be labelled are vine-ripened tomatoes, then the range of foreground colours may be reds. Further, a range of greens may be retrieved as indicating the colour of the obstructing vines.

The conveyor 16 may then be advanced in downstream direction D to convey trays 28, loaded with the indicated products, toward labelling apparatus 10. When the leading edge of a tray 28 reaches photocell 29, the photocell prompts the camera 24 to image the tray. The camera then sends this image to processor 22 (S112). The processor can then process this image as follows. With knowledge of the range of colours representative of the product, the processor can electronically filter out from the image all but this range of colours to obtain a first (product colour) filtered image. (S114). The processor can also electronically filter out the range of colours representative of the background colours, i.e., the colour of the trays, in order to obtain a second (background colour) filtered image (S116). Further, if the memory 23 has an indication that there is a range of colours associated with obstructions, with knowledge of this range of colours, the processor can electronically filter out from the camera image all but this range of colours in order to obtain a third (obstruction colour) filtered image (S118). As an alternative to the processor electronically filtering the camera image, physical filters 25 may be placed in front of the camera. In such instance, the camera may take up to three (rapid) consecutive images and the processor may control which of the filters is in front of the camera while each image is taken. (The control path to the optional filters 25 is not shown.)

The processor may then establish groups of blobs, each group representing a product. In doing so, the processor may overlay the second filter on the first filter in order to assist in establishing the perimeter of each group of blobs. Further, the processor may overlay the third filter on the first filter in order to better delineate the boundary between the blobs and obstructions. Additionally, the processor may connect separated blobs in a group, at least where such orphan blobs are not separated by areas represented in the third filtered image (S120).

Figure 4:
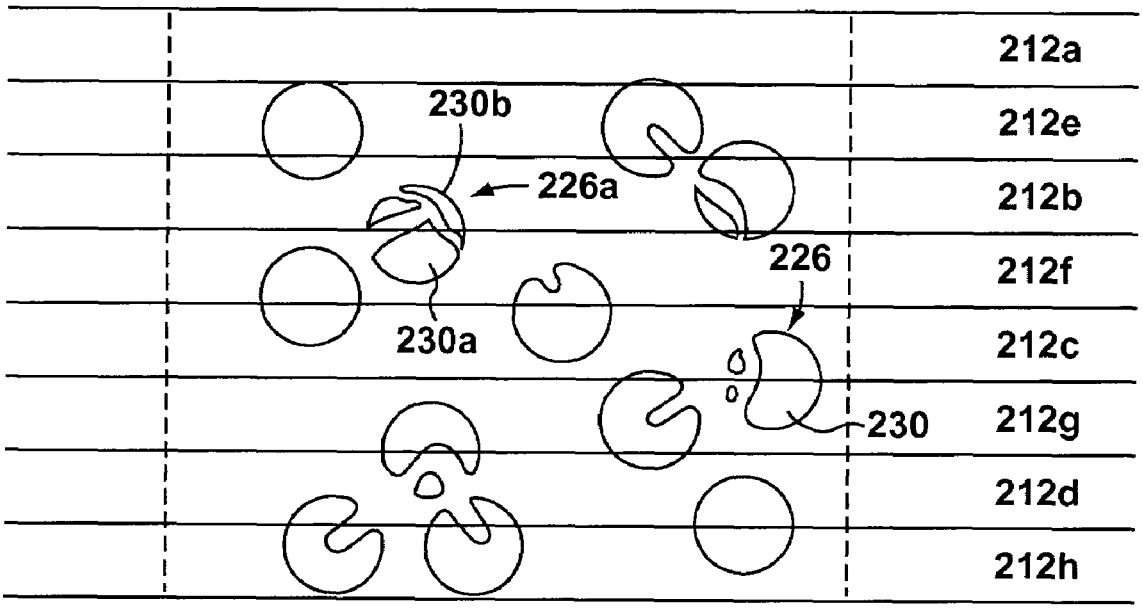
FIG. 4 is a schematic view of a construct of the processor.

The resulting groups 226 of blobs 230 for the tray 28 illustrated in FIG. 1 are illustrated in FIG. 4. Each labeller 12 (FIG. 1) can label a product which lies within a certain range of transverse positions on the conveyor 16. The processor may therefore overlay "swaths" (or paths) 212 on the groups 230 of blobs where each swath represents the range of transverse positions over which one labeller can label a product. Thus, for example, swath 212*b* represents the transverse positions over which labeller 12*b* may label a product, and so on. For each group of blobs, the processor may then select a blob that is comfortably within a given swath 212. The selection process may involve looking for the largest blob that is comfortably within a given swath. For example, for group 226*a* (which represents product 26*a* of FIG. 1), the processor may note that blob 230*b* is comfortably within swath 212*b* and that blob 230*a* is comfortably within swath 212*f*. In this instance, the processor may select blob 230*a*, as it is the larger of the two blobs.

Once the processor has identified an appropriate swath 212 for a given group of blobs, it chooses the labeller 12 associated with that swath as the labeller to label the product which is represented by the given group of blobs (S122).

When the photocell 29 detects the leading edge of a tray, the tray is a known distance from labellers 12. This detection signal may be input from the photocell directly to processor 22. Alternatively, this signal may be indirectly received by the processor as the image signal from camera 24. With the processor knowing when the leading edge of a tray is at the photocell and knowing the speed of the conveyor from speed indicator 32, the processor will be aware when each product 26 in tray 28 reaches one of the banks 18 of labellers 12. Thus, the processor can track a product represented by a given group of blobs reaches each bank of labellers. Therefore, the processor can signal the labeller which it chose to label a product represented by the given group of blobs at an appropriate time (S124). Put another way, the processor can track the progress of the tray by notionally progressing the image of the groups of blobs with respect to notional banks of labellers. In this way, the processor will know when a given group of blobs reaches each notional bank of labellers and can fire the chosen labeller for the given group of blobs at the appropriate time.

Optionally, the processor may establish groups of blobs with only a filtered image leaving the first range of colours representing a product. However, such an approach is not likely to be as robust as one which also uses a filtered image leaving the background colours. And, where there are obstructions, the approach becomes even more robust if use is made of a filtered image leaving the obstruction colours.

Optionally, rather than using colour-based blob analysis, a monochrome blob analysis may be used. More particularly, the imager 24 may be a monochrome camera and different grey-scales may be considered to be indicative of different colours. More particularly, the processor may retrieve from memory 23 a range of grey-scales indicative of the predominant colour of the products, a range of grey-scales indicative of background colours (i.e., the colour of the trays), and a range of grey-scales indicative of obstructions. Mechanical or electronic filtering may be used to obtain images of the different ranges of grey-scales which are indicative of the selected colours. Blob-based analysis may then proceed as described hereinbefore in order to target products for labelling.

As an option to a blob-based analysis, with an appropriate imager 24, processor 22 may obtain and analyse topographic images. For example, the processor 22 may be configured to generate a topographic image (without colour information) from output received from stereoscopic cameras (as, for example, infra-red cameras), ultrasonic imagers, sonar imagers, or radar imagers. Processor 22 may then be configured to analyse the topographic image to identify topographies indicative of products and then select a suitable high point on each product for labelling. Product recognition may be accomplished in any suitable fashion, such as with a neural network. Where there are obstructions (stems), the processor may also be configured to identify, and avoid labelling, these.

Other modifications will be apparent to those skilled in the art and, therefore, the invention is defined in the claims.

What is claimed is:

1. A method for labelling agricultural produce, comprising:

providing a plurality of labellers;

directly imaging products;

from said imaging, identifying a target portion of a product that is appropriate for receiving a label, that will pass a target area of a given labeller; and tracking progress of said target portion of said product and controlling an appropriate one of said plurality of labellers to label said target portion of said product when said target portion of said product is at said target area of said given one of said plurality of labellers.

2. A method for labelling agricultural produce, comprisings:

imaging products;

filtering said image to leave a first range of colours representative of colours of said products;

obtaining a plurality of groups of blobs, each blob comprising an area of the first range of colours and each group of blobs representing one of said products;

selecting a blob from a given group of blobs, which blob represents a portion of a given product which will pass a target area of a given labeller and tracking said given product represented by said given group of blobs and controlling said given labeller to label said portion of said given product.

3. Product labelling apparatus, comprising:

a plurality of labellers, each for labelling a product which is within a target area;

an imager for directly imaging the products;

a processor responsive to an output of said imager and operatively connected to a control input of each of said plurality of labellers for:

processing an image received from said imager to identity a target portion of a product that is appropriate for receiving a label, which portion will pass a target area of a given labeller; and tracking progress of said target portion of said product and controlling an appropriate one of said plurality of labellers to label said target portion of said product when said target portion of said product is at said target area of said given one of said plurality of labellers.

4. The product labelling apparatus of claim 3 further comprising a conveyor adapted move said products through a field of view of said imager and past said labeller.

5. The product labelling apparatus of claim 3 wherein said products are items of agricultural produce.

6. The product labelling apparatus of claim 5 wherein said plurality of labellers are tamping labellers.

7. The product labelling apparatus of claim 3 wherein said processor is for processing an image to generate a topographic image and to analyse said topographic image to identify topographies indicative of products and select a high point on each product for labelling.

8. The product labelling apparatus of claim 7 wherein said imager is a stereoscopic camera.

9. The product labelling apparatus of claim 7 wherein said imager in ages with sound waves.

10. The product labelling apparatus of claim 7 wherein said imager is a radar imager.

11. Product labelling apparatus, comprising:

a plurality of labellers, each for labelling a product which is within a target area;

an imager for imaging products;

a processor responsive to an output of said imager and operatively connected to a control input of each of said plurality of labellers for:

processing an image received from said imager to identify a portion of a product which portion will pass a target area of a given labeller; and tracking progress of said portion of said product and controlling an appropriate one of said plurality of labellers to label said portion of said product when said portion of said product is at said target area of said given one of said plurality of labellers wherein said imager is a colour camera and further comprising a filter for filtering out all but a first range of colours from said image or from light impinging on said camera such that a filtered image is available to said processor.

12. The product labeller of claim 11 wherein said processing an image comprises:

processing said filtered image to obtain a plurality of groups of blobs, each blob comprising an area of said first range of colours., each group of blobs representing a product; and selecting a blob from a given group of blobs based on said target area of each of said labellers, said selected blob representing said portion of said product which portion will pass a target area of said given labeller.

13. The product labelling apparatus of claim 12 wherein said filter is a physical filter in front of said camera.

14. The product labelling apparatus of claim 12 wherein said filter is an electronic filter.

15. The product labelling apparatus of claim 14 wherein said electronic filter is implemented in said processor.

16. The product labelling apparatus of claim 12 further comprising a second filter for filtering out all but a second range of colours representative of a background colour from said image or from light impinging from said camera.

17. The product labelling apparatus of claim 16 wherein said processor is further for connecting blobs in each group of blobs to represent a product and wherein said selecting is undertaken after said connecting.

18. The product labelling apparat is of claim 17 wherein said connecting comprises overlaying said filtered camera image representative of said background colour on said filtered image having said first range of colours to assist in identifying said groups of blobs.

19. The product labelling apparatus of claim 18 further comprising a third filter for filtering out all but a third range of colours representative of colours of obstructions and wherein said connecting comprises overlaying said filtered image representative of said colours of obstructions on said filtered image having said first range of colours to assist in identifying said group of blobs.

20. The product labelling apparatus of claim 19 wherein said products are red tomatoes, groups of said tomatoes being connected by green vines and wherein said filter passes red tight and said third, filter passes green light.

21. The product labelling apparatus of claim 12 wherein said selecting is also based on sizes of blobs in said given group of blobs.

22. Product labelling apparatus, comprising:

a plurality of labellers, each for labelling a product which is within a target area;

an imager for imaging products;

a processor responsive to an output of said imager and operatively connected to a control input of each of said plurality of labellers for:

processing an image received from said imager to identify a portion of a product which portion will pass a target area of a given labeller; and tracking progress of said portion of said product and controlling an appropriate one of said plurality of labellers to label said portion of said product when said portion of said product is at said target area of said given one of said plurality of labellers wherein said imager is a monochrome camera and further comprising a filter for filtering out all but a first range of grey-scales from said image or from light impinging on said camera such that a filtered image is available to said processor.

23. The product labeller of claim 22 wherein said processing an image comprises:

processing said filtered image to obtain a plurality of groups of blobs, each blob comprising an area of said first range of grey-scales, each group of blobs representing a product; and selecting a blob from a given group of blobs based on said target area of each of said labellers, said selected blot representing said portion of said product which portion will pass a target area of said given labeller.

24. A product labelling apparatus, comprising:

a labeller for labelling products;

a camera for capturing a direct image of a product;

a processor responsive to receiving said image from said camera and operatively connected to a control input of said labeller for:

processing said image of said product to reduce said image to a representation of a plurality of blobs;

analysing said representation to select a target blob of said plurality of blobs within a labelling area of said labeler and appropriate to receive a label; and controlling said labeller such that said labeller applies a label to a target area of said product, where said target area of said product corresponds to said target blob of said plurality of blobs within said labelling area of said labeller.

* * * * *

UNITED STATES PATENT AND TRADEMARK OFFICE

CERTIFICATE OF CORRECTION

PATENT NO. : 7,153,378 B2
APPLICATION NO. : 10/719636
DATED : December 26, 2006
INVENTOR(S) : Sleiman et al.

It is certified that error appears in the above-identified patent and that said Letters Patent is hereby corrected as shown below:

Column 7, Claim 9, Line 9:
"in ages" should be -- images --.

Column 7, Claim 18, Line 55:
"apparat is" should be -- apparatus --.

Column 8, Claim 20, Line 9:
"red tight" should be -- red light --.

Signed and Sealed this

Thirty-first Day of July, 2007

JON W. DUDAS
*Director of the United States Patent and Trademark Office*